US007114454B2

(12) United States Patent
Block et al.

(10) Patent No.: US 7,114,454 B2
(45) Date of Patent: Oct. 3, 2006

(54) NEEDLE BAR DRIVER ASSEMBLY FOR A SEWING MACHINE

(76) Inventors: Paul Block, 63 Mayfair Rd., Nesconset, NY (US) 11767; Michael Lydick, 2703 Heather Ave., Medford, NY (US) 11763; Lewis Doom, 28 Acorn La., Stony Brook, NY (US) 11790

( * ) Notice: Subject to any disclaimer, the term of this patent is extended or adjusted under 35 U.S.C. 154(b) by 0 days.

(21) Appl. No.: 10/862,991

(22) Filed: Jun. 8, 2004

(65) Prior Publication Data

US 2004/0244662 A1 Dec. 9, 2004

Related U.S. Application Data

(63) Continuation-in-part of application No. 10/359,447, filed on Feb. 6, 2003, now abandoned.

(51) Int. Cl.
*D05B 55/14* (2006.01)

(52) U.S. Cl. ..... 112/221

(58) Field of Classification Search ..... 112/284, 112/220, 221, 162, 259, 172, 177, 160
See application file for complete search history.

(56) References Cited

U.S. PATENT DOCUMENTS

| | | | | | |
|---|---|---|---|---|---|
| 1,538,744 | A | * | 5/1925 | Ray | 112/157 |
| 3,450,081 | A | * | 6/1969 | Rabinow | 112/221 |
| 3,645,221 | A | * | 2/1972 | Hirayama | 112/221 |
| 4,190,006 | A | * | 2/1980 | Mellor | 112/80.42 |
| 4,254,722 | A | * | 3/1981 | Minella et al. | 112/221 |
| 4,259,916 | A | * | 4/1981 | Marchesi | 112/221 |
| 4,616,585 | A | * | 10/1986 | Marcandalli | 112/221 |
| 4,790,253 | A | * | 12/1988 | Kasuda | 112/221 |

* cited by examiner

*Primary Examiner*—Ismael Izaguirre
(74) *Attorney, Agent, or Firm*—Keusey, Tutunjian & Bitetto, P.C.

(57) ABSTRACT

There is provided a needle bar driver assembly for an overlock sewing machine having a needle for penetrating a material to be sewed and a needle bar for securing the needle thereto. The needle bar driver assembly includes a main shaft, a floating pivot, and a linking mechanism. The main shaft provides an oscillating motion. The linking mechanism is coupled to the main shaft and to the floating pivot, and transfers the oscillating motion of the main shaft to the needle bar while pivoting on the floating pivot.

21 Claims, 9 Drawing Sheets

NEEDLE BAR DRIVER ASSEMBLY FOR A SEWING MACHINE

RELATED APPLICATION INFORMATION

This application is a Continuation-in-Part of U.S. patent application Ser. No. 10/359,447, filed Feb. 6, 2003, now abandoned.

FIELD OF THE INVENTION

The present invention generally relates to sewing machines and, more particularly, to a needle bar driver assembly for a sewing machine.

BACKGROUND OF THE INVENTION

Conventional sewing machines employ a solid driver bar that drives the needle bars, and hence the needles, in an oscillating motion. However, the use of a solid driver bar limits the upper travel limit of the needle bars, and hence the needles, making it difficult for an operator to insert and remove thick materials during a sewing operation.

Accordingly, it would be desirable and highly advantageous to have a needle bar driver assembly that extends the upper travel limit of the needle bar, and hence the needles, to reduce the difficulties associated with inserting and removing thick materials during a sewing operation.

SUMMARY OF THE INVENTION

The problems stated above, as well as other related problems of the prior art, are solved by the present invention, a needle bar driver assembly for a sewing machine.

According to an aspect of the present invention, there is provided a needle bar driver assembly for an overlock sewing machine having a needle for penetrating a material to be sewed and a needle bar for securing the needle thereto. The needle bar driver assembly includes a main shaft, a floating pivot, and a linking mechanism. The main shaft provides an oscillating motion. The linking mechanism is coupled to the main shaft and to the floating pivot, and transfers the oscillating motion of the main shaft to the needle bar while pivoting on the floating pivot.

According to another aspect of the present invention, there is provided a needle bar driver assembly for an overlock sewing machine having a needle for penetrating a material to be sewed and a needle bar for securing the needle thereto. The needle bar driver assembly includes a main shaft, an actuating piston, and a linking mechanism. The main shaft provides an oscillating motion. The actuating piston provides reciprocating motion. The floating pivot is connected to the actuating piston. The linking mechanism is coupled to the main shaft and to the floating pivot, and transfers the oscillating motion of the main shaft to the needle bar while pivoting on the floating pivot.

According to another aspect of the present invention, there is provided a needle bar driver assembly for an overlock sewing machine having a needle for penetrating a material to be sewed and a needle bar for securing the needle thereto. The needle bar driver assembly includes a main shaft, an actuating piston, a floating pivot, and a linkage. The main shaft provides an oscillating motion. The actuating piston provides reciprocating motion. The floating pivot is connected to the actuating piston. The linkage is coupled to the main shaft and to the floating pivot. The linkage has a configurable geometry dependent upon a current position of the floating pivot, and transfers the oscillating motion of the main shaft to the needle bar while pivoting on the floating pivot.

These and other aspects, features and advantages of the present invention will become apparent from the following detailed description of preferred embodiments, which is to be read in connection with the accompanying drawings.

DETAILED DESCRIPTION OF THE INVENTION

Figure 1:
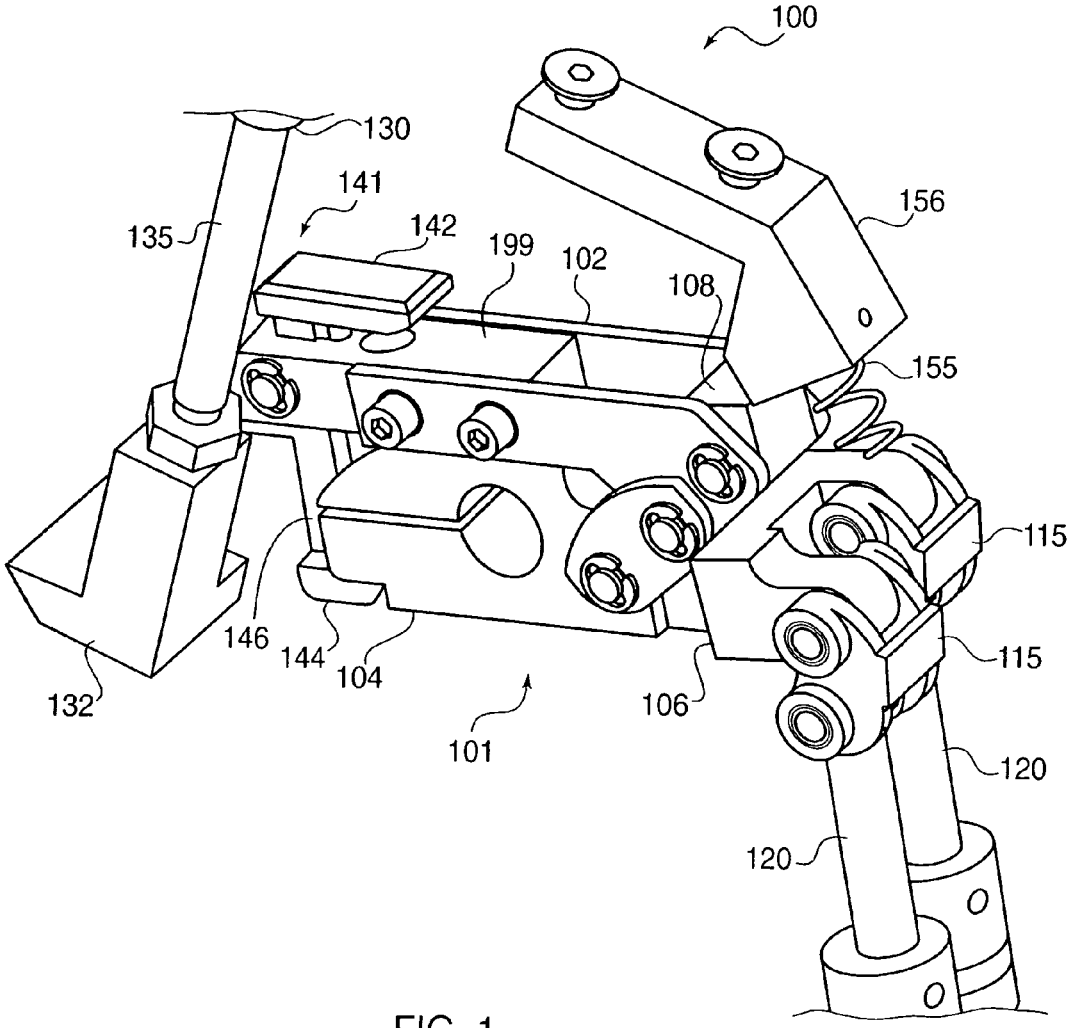
FIG. 1 is a diagram illustrating a needle bar driver assembly 100 in a locked condition, according to an illustrative embodiment of the present invention.

The present invention is directed to a needle bar driver assembly for a sewing machine. Advantageously, the present inventions allows for thick, quilted materials to be sewn by raising the upper travel limit of the needle and presser foot of the sewing machine. The present invention accomplishes the preceding without affecting (slowing down) the speed of the sewing machine, as well as preserving the original factory timing relationships of the sewing machine parts, most noticeably the timing of the needles to the loopers.

It is to be appreciated that the present invention is directed to "overlock" types of sewing machines, which are also referred to as, for example, "overedge", "overcast", "overhead", and "serger" type sewing machines. For the purposes of the present invention, it is presumed that a sewing machine to which the present invention is to be applied includes or is adapted to be able to include a presser foot assembly for raising and lowering a presser foot, a looper for manipulating a thread, a needle for penetrating a material to be sewed, and a throat plate for allowing the needle to pass there through. The presser foot is for pressing down on the material to be sewed.

In one embodiment of the present invention, the present invention includes a needle bar for securing the needle thereto and a needle bar connecting link assembly for driving the needle bar. Moreover, the present invention includes an oscillating needle bar driving assembly for driving the needle bar connecting link assembly in synchronization with a timing of the looper and for raising the needle bar connecting link assembly such that the needle is more than 18 mm above the throat plate. A presser foot assembly raises the presser foot a distance corresponding to the distance at which the needle is raised. The correspondence between the distances at which the needle and presser foot are lifted is necessary to prevent the needle from sticking through the bottom plane of the presser foot and tearing the material that is to be sewed. It is to be appreciated that while a distance of more than 18 mm is used herein as the example distance from the needle and presser foot to the throat plate, even greater distances (20, 22, 24, 27, 30, 40, and so forth) may be readily achieved by the present invention as is apparent to one of ordinary skill in the art given the teachings of the present invention provided herein.

As is known, the presser foot assembly includes a presser foot (also interchangeably referred to herein as "material clamp") that is connected to a presser foot arm. The presser foot arm is also connected to a carriage. The carriage is connected to a slide or actuating cylinder. The slide is connected to a main casting (main body) of the sewing machine. The preceding presser foot assembly provides linear displacement of the presser foot. As is also known, radial displacement of the presser foot may also be employed. In the case of radial displacement, the carriage is replaced by a pivot block to provide angular (radial) displacement of the presser foot. The present invention may be used with the preceding types or any type of presser foot assembly, while maintaining the spirit and scope of the present invention.

More detailed descriptions of various aspects of the present invention will now be given with respect to FIGS. 1–5 below.

FIG. 1 is a diagram illustrating a needle bar driver assembly 100 in a locked condition, according to an illustrative embodiment of the present invention. A driver bar assembly 101 (hereinafter interchangeably referred to as "4 bar assembly") transfers oscillating motion from a main rocking shaft (not shown) to needle bar connecting links 115, that in turn drive needle bars 120 (and, thus, needles 125) upwards and downwards at their prescribed angle. It is to be appreciated that the prior art employs a solid driver bar. In contrast, the present invention breaks up the driver bar into a locking (and unlocking) 4 bar linkage, that when unlocked, allows the upper most limit of needle bars 120 and, hence, needles 125 coupled thereto, to be extended a significant angular distance. This increased secondary lift dramatically reduces the difficulties (and secondary consequences) associated with inserting and removing the thick quilted materials associated with this sewing operation. The 4 bar assembly 101 includes an upper link 102, a main beam 104, an outer link 106, and a coupling link 108. It is to be appreciated that while the 4 bar linkage described herein includes 4 bars, hence the name, more or less than 4 bars may be employed, as contemplated by one of ordinary skill in the related art, to lift the needles a greater distance than that obtained by the prior art.

The opening of 4 bar assembly 101 is achieved through a first actuating cylinder 130 (hereinafter interchangeably referred to a "lifting cylinder") and associated lifting shelf 132 attached to the end of a piston 135 movably disposed in lifting cylinder 130. The sewing machine is programmed to stop with the needles at their highest angular position. At this time, when actuated by the operator, the lifting shelf 132 is raised upwards, unlocking a locking latch 141 and immediately following upper link 102 of the 4 bar assembly 101 (see FIG. 2). The locking latch 141 (hereinafter also referred to as "latch") includes a top ledge 142 coupled to a bottom catch 144 (hereinafter "catch") via an intermediate member 146. The locking latch 141 is coupled to upper link 102 via a connecting member 199. However, in another embodiment of the present invention, locking latch 141 is directly coupled to upper link 102. Moreover, in yet another embodiment of the present invention, the physical structure and function represented by connecting member 199 may be incorporated into either locking latch 141 and/or upper link 102.

An opposing spring 155 and spring block 156 shown in FIG. 1 are described in detail below with respect to FIGS. 2 and 4.

Figure 2:
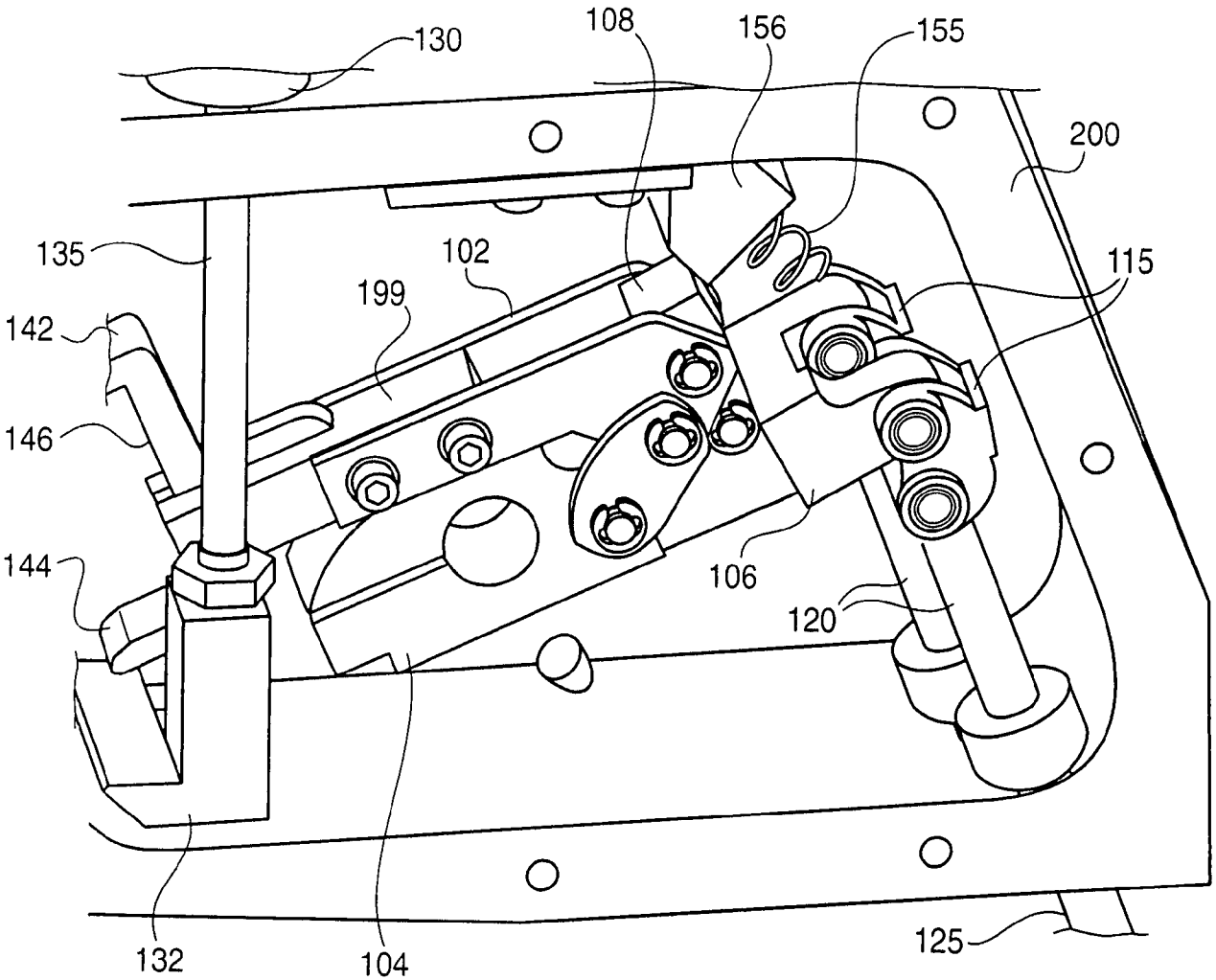
FIG. 2 is a diagram illustrating the interior of a needle bar drive chamber 200 that includes the needle bar driver assembly 100 shown in FIG. 1, according to an illustrative embodiment of the present invention.

FIG. 2 is a diagram illustrating the interior of a needle bar drive chamber 200 that includes the needle bar driver assembly 100 shown in FIG. 1, according to an illustrative embodiment of the present invention. Observe the now visible catch 144 of locking latch 141 that once held upper link 102 of 4 bar assembly 101 locked downwards to main beam 104 of 4 bar assembly 101.

The spring block 156 is coupled to the needle bar drive chamber 200 to provide a solid base from which opposing spring 155 can push away from. Needles 125 are shown coupled to needle bars 120.

Figure 3A:
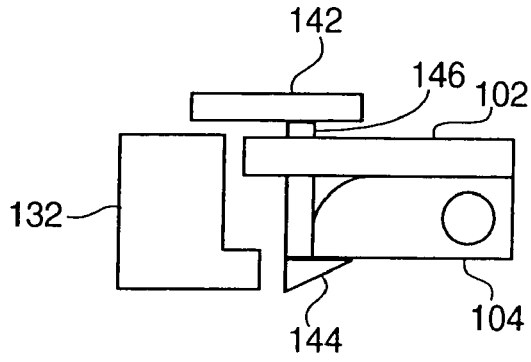
FIGS. 3A–C are diagrams generally illustrating the unlocking of the needle bar driving assembly 101 shown in FIG. 1, according to an illustrative embodiment of the present invention.
Figure 3B:
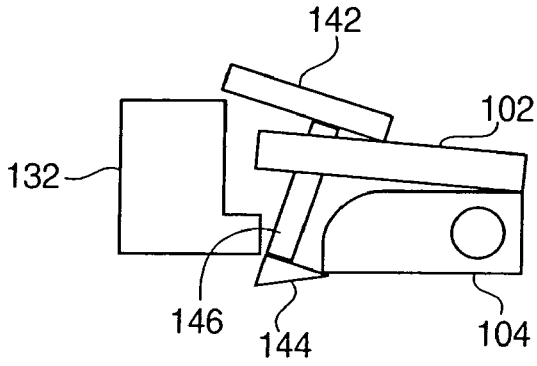
Figure 3C:
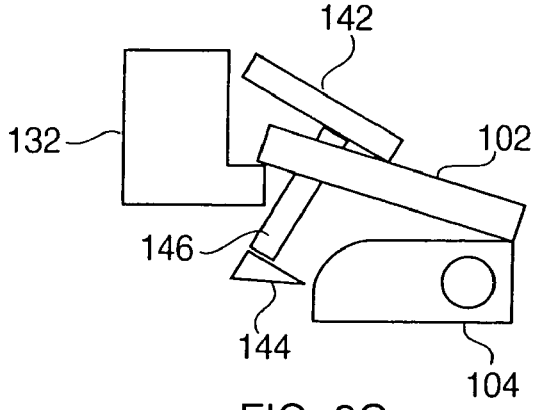

FIGS. 3A–C are diagrams generally illustrating the unlocking of the needle bar driving assembly 101 shown in FIG. 1, according to an illustrative embodiment of the present invention. FIG. 4 is a diagram illustrating the needle bar driver assembly 100 of FIG. 1 in an unlocked condition, according to an illustrative embodiment of the present invention.

When lifting shelf 132 is raised, it first hits top ledge 142 of locking latch 141, relieving the spring pressure and pivoting catch 144 to the left and upwards, away from main beam 104 of 4 bar assembly 101 (see FIG. 3A).

Once catch 144 is free, lifting shelf 132 continues to lift upper link 102, breaking 4 bar assembly 101 open (see FIGS. 3B and 3C). Observe the open condition of assembly 101, and how the outer most link 106 attached to needle bar connecting link 115 raises needle bar connecting links 115 and needle bars 120 an additional angular distance (see FIG. 4). The coupling link 108 operatively couples upper link 102 to outer link 106, so that the lifting of upper link 102 results in a corresponding lifting of outer link 106 away from main beam 104. Fully, upper link 102 and outer link 106 are operatively coupled together such that the position of outer link 106 tracks the position of upper link 102. In the illustrative embodiment of the present invention, a tongue and groove structure is employed to provide positional tracking between outer link 106 and upper link 102. The tongue and groove structure is disposed between coupling link 108 and outer link 106. As is known to one of ordinary skill in the related art, the tongue portion and the groove portion of the tongue and groove structure may be readily disposed on coupling link 108 and outer link 106, respectively, or vice versa, depending on, for example, the shape (e.g., concave, convex) of the tongue portion. It is to be appreciated that while a tongue and groove structure are described herein for enabling the tracking of the outer link position to the upper link position, other structures may be readily used to achieve the same position tracking result as are readily contemplated by one of ordinary skill in the related art, while maintaining the spirit and scope of the present invention.

This motion is synchronized with the lifting of a material clamp (not shown), allowing the operator to insert or remove the material as needed. As long as the operator's foot is actuating the sewing pedal backwards (not shown) the sewing machine will remain in this condition.

The opposing spring 155 and spring block 156 apply pressure to outer link 106 of 4 bar assembly 101, acing as a compressive stop. This spring 155 will also encourage outer link 106 to rotate back into its locked position, as well as prevent outer link 106 from over rotating and locking 4 bar assembly 101 in an "open" condition.

Figure 4:
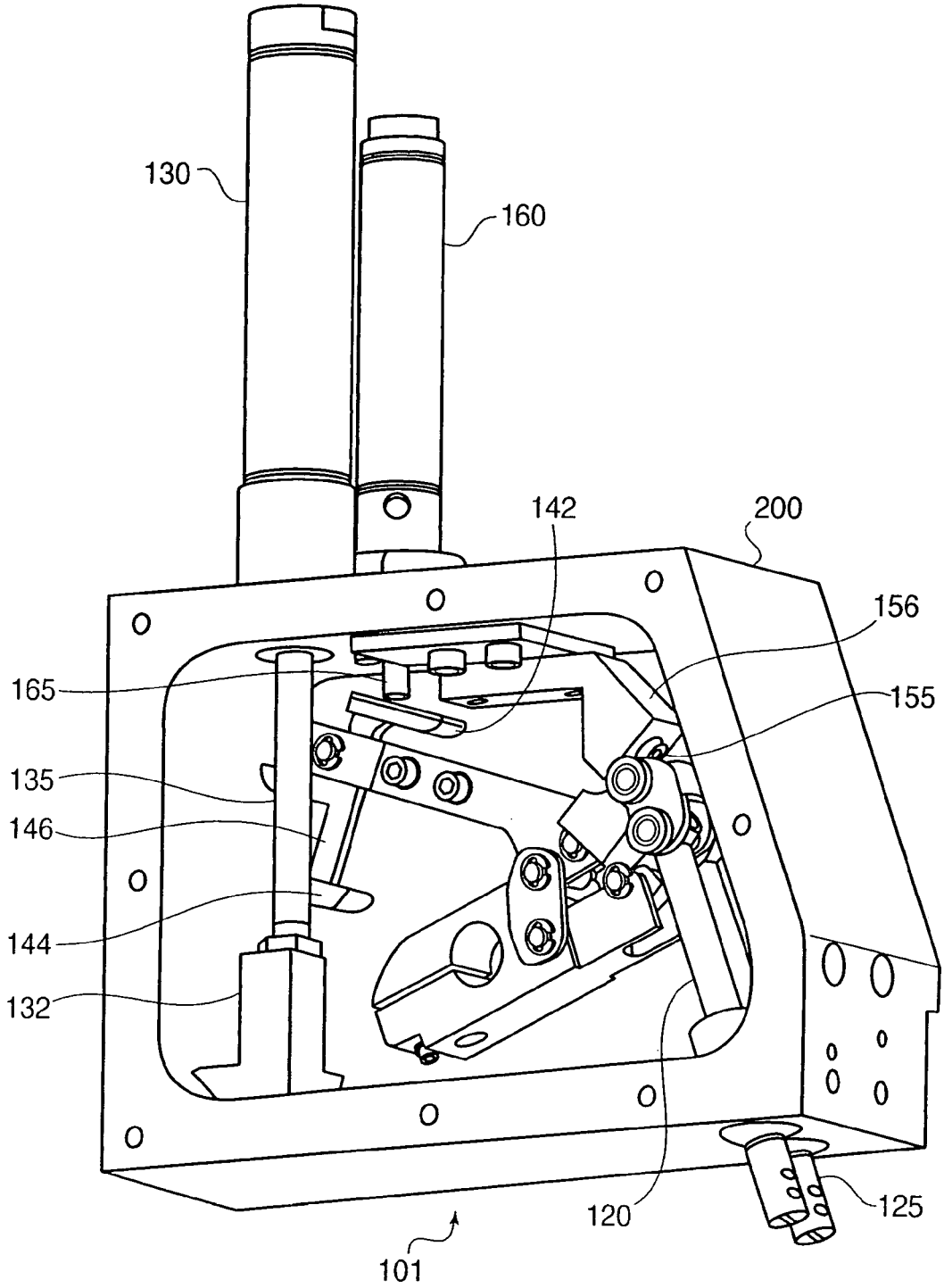
FIG. 4 is a diagram illustrating the needle bar driver assembly 100 of FIG. 1 in an unlocked condition, according to an illustrative embodiment of the present invention.

A second actuating cylinder 160 (hereinafter interchangeably referred to as locking cylinder) and its associated piston 165 are shown in FIG. 4. When the operator releases the sewing pedal (not shown), second actuating cylinder 160 actuates piston 165 downwards to its lowest "docking" point. At this extent of its limit, lifting shelf 132 will not interfere with oscillating 4 bar assembly 101.

The 4 bar assembly 101 would remain open, however, and unlocked, if not for locking cylinder 160. When piston 165 of locking cylinder 160 actuates downwards, piston 165 depresses the top ledge 142 of the locking latch 141, and consequently, upper bar 102 of 4 bar assembly 101. Piston 165 continues to depress latch 141 until catch 144 locks beneath the lower plane of main beam 104 of 4 bar assembly 101. This actuation is momentary, releasing and raising upwards (and remaining there) fractions of a second after it locks the mechanism. When 4 bar assembly 101 is locked, and locking cylinder 160 is fully retracted, the sewing machine operator proceeds and runs the machine through its cycle. The 4 bar driving assembly 101 remains locked until the unit stops and performs its lifting cycle once again.

Figure 5:
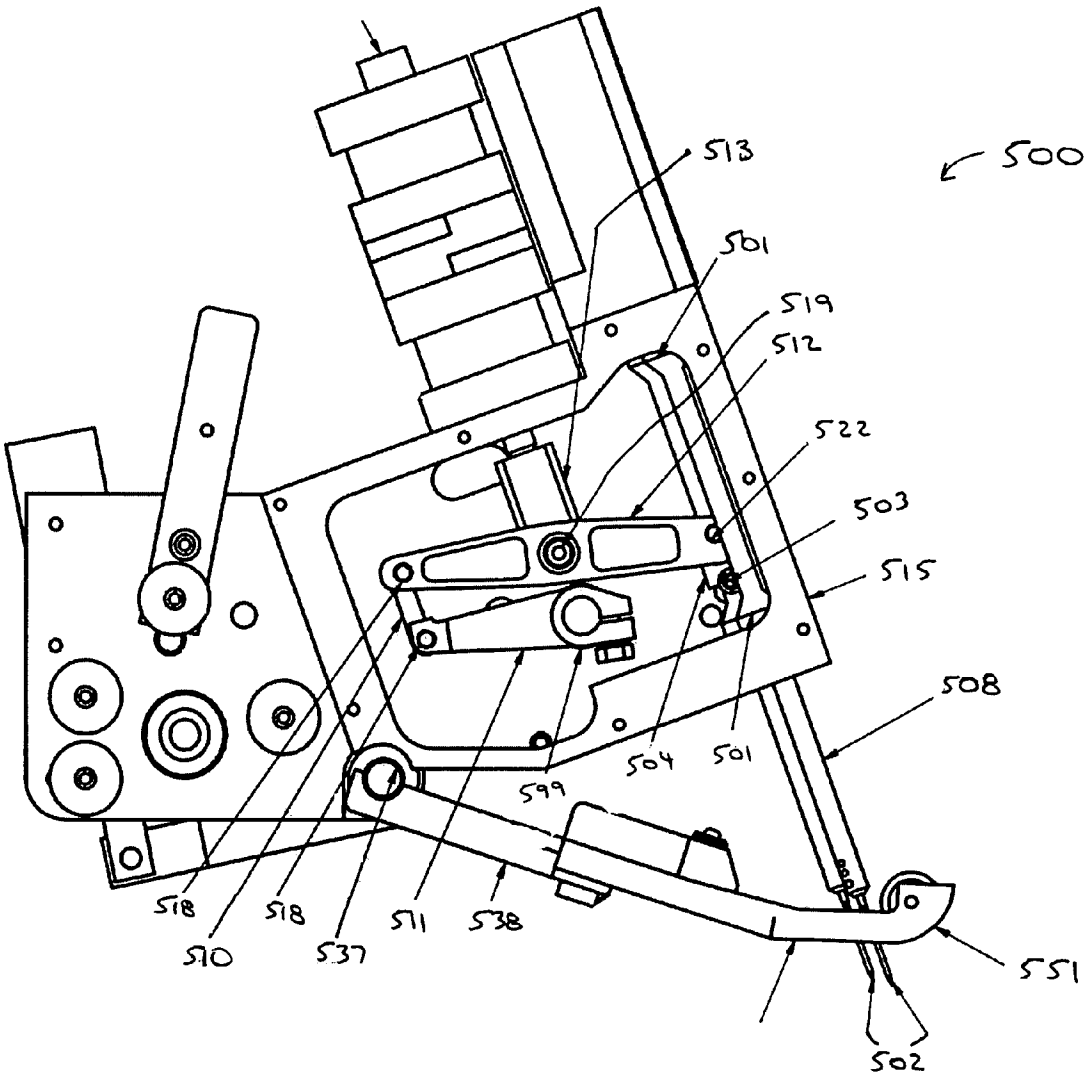
FIG. 5 is a diagram illustrating a needle bar driver assembly 500, according to another illustrative embodiment of the present invention.

FIG. 5 is a diagram illustrating a needle bar driver assembly 500, according to another illustrative embodiment of the present invention.

A presser foot 551 is connected to a presser foot arm 538 that pivots on a pivot shaft 537. Needles 502 are connected to needle bars 508 that travel in the axis of needle bar bushings 501, which are held in place by a needle bar assembly housing 515.

The needle bars 508 are driven up and down relative to their constrained axis of travel by a needle bar clamp 504 thru a clamp pivot pin 503. The needle bar clamp 504 receives its transferred motion through a top clamp pivot pin 522, which receives its transferred motion through a rocker arm 512.

A main shaft 599 of the sewing machine is an oscillating shaft with clockwise and counterclockwise limit to its rotary travel along an axis normal to the page, which in conventional sewing equipment would normally connect directly to the needle bar clamp 504 and determine the lower and upper heights of travel of the needles 502.

However, in FIG. 5, the drive arm 511 does not connect directly to the needle bar clamp 504 but to a connecting link 510 via a pin 518. The connecting link 510 transfers the oscillating rocking motion to the rocker arm 512, which pivots on a floating axis centered on a clevis pin (hereinafter also referred to as "floating pivot") 519. The clevis pin 519 is attached to a clevis 513 that, in turn, is attached to a piston of the actuator 514. The piston of the actuator 514 is fastened to the needle bar assembly housing 515 and constrained to travel in a direction normal to the top face of the needle bar assembly housing 515, with a maximum height and minimum height (maximum defined as the upper limit, minimum as defined by the lower limit) determined by the stroke of the actuator 514.

When the rocker arm receives its oscillating motion, that motion is transferred to the needle bars 518 thru the needle bar clamp 504 via the top clamp pivot pin 522 and the clamp pivot pin 503.

In FIG. 5, the needle bars 508 are shown at their lowest point of axial travel. The main shaft 599 has reached its maximum rotation limit (clockwise). The presser foot 515 is shown level, and flat.

Figure 6:
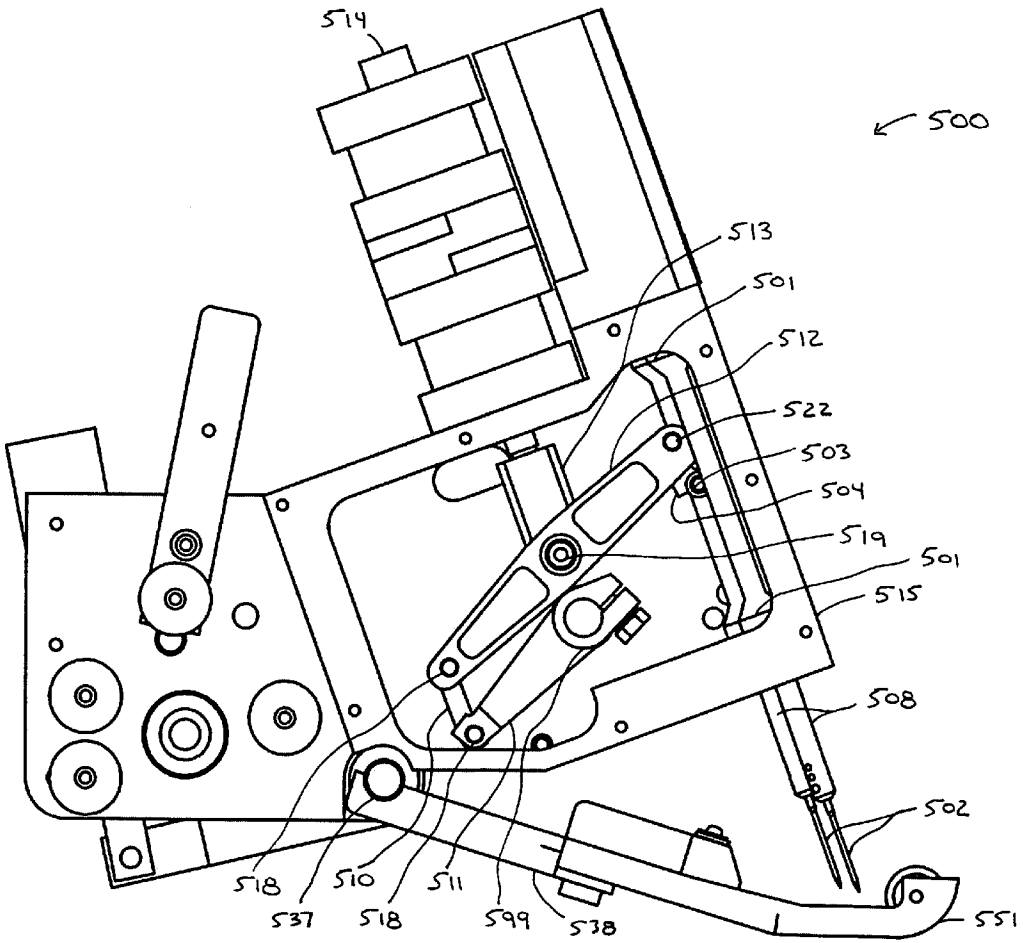
FIG. 6 is a diagram illustrating the needle bar driver assembly 500 of FIG. 5, according to another illustrative embodiment of the present invention.

FIG. 6 is a diagram illustrating the needle bar driver assembly 500 of FIG. 5, according to another illustrative embodiment of the present invention.

In FIG. 6, the main shaft 599 has rocked back (counterclockwise) to its minimum rotation limit and in so doing has lifted the needle bars 508 and needles 502 to their normally maximum limit of travel, transferring the motion through the drive arm 511, connecting link 510, rocker arm 512 and needle bar clamp 504.

Figure 7:
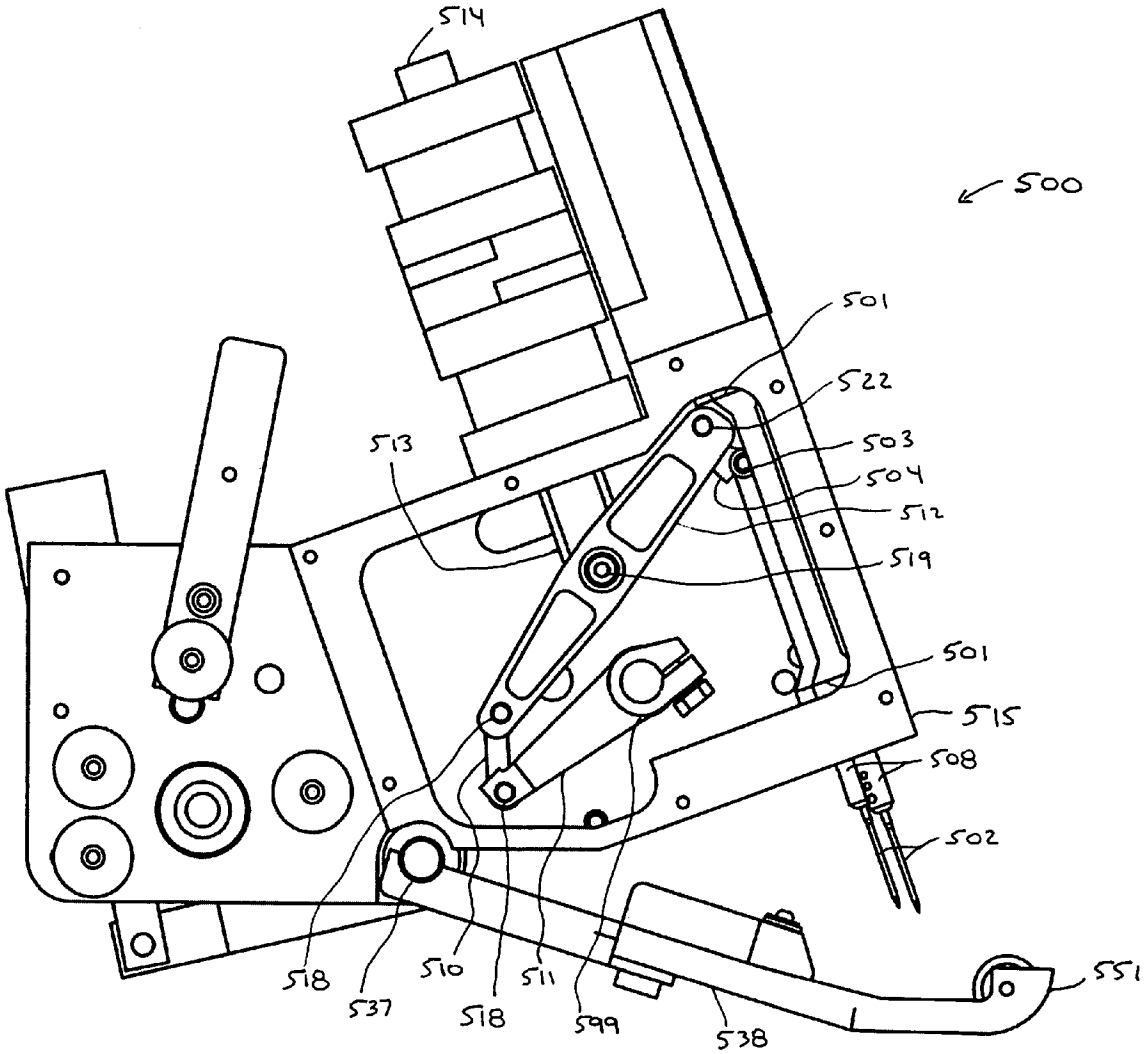
FIG. 7 is a diagram illustrating the needle bar driver assembly 500 of FIG. 5, according to yet another illustrative embodiment of the present invention.

FIG. 7 is a diagram illustrating the needle bar driver assembly 500 of FIG. 5, according to yet another illustrative embodiment of the present invention.

In FIG. 7, the actuator 514 has been pressurized and locked upwards, lifting the piston and clevis 513 upwards, in a direction normal to the top surface of the needle bar assembly housing 515, consequently lifting the clevis pin 519. By moving the clevis pin 519 the unit changes the location of the pivot axis of the rocker arm 512 and super extends the upper limit of travel of the needle bar 508.

Figure 8:
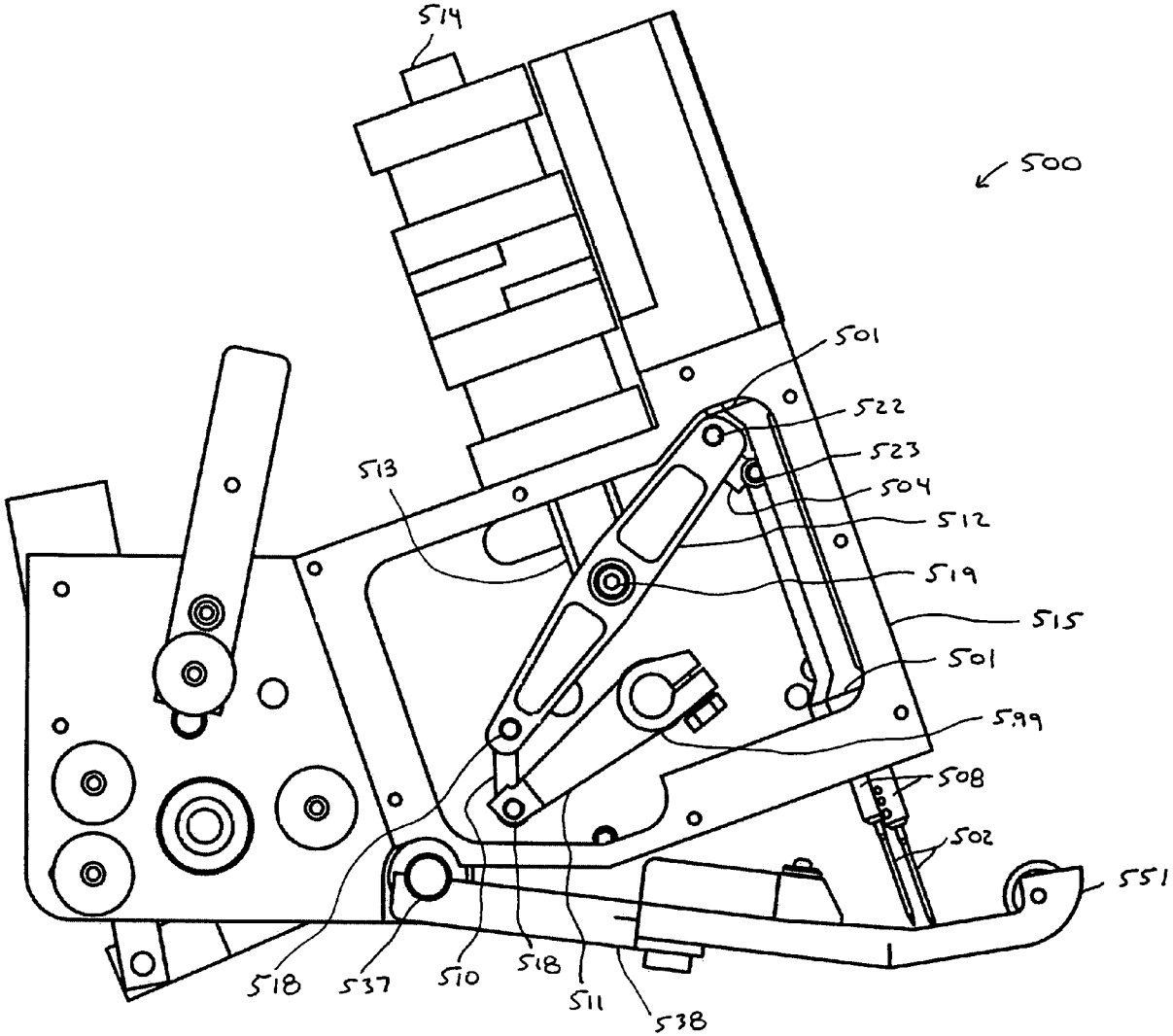
FIG. 8 is a diagram illustrating the needle bar driver assembly 500 of FIG. 5, according to yet another illustrative embodiment of the present invention.

FIG. 8 is a diagram illustrating the needle bar driver assembly 500 of FIG. 5, according to yet another illustrative embodiment of the present invention.

In FIG. 8, an actuator (not shown) rotates the pivot shaft 513 of the presser foot arm 551, which raises the presser foot 551 such that the lower face of the presser foot 551 is tangent to the points of the needles 502 allowing for easy entry and removal of materials.

Figure 9:
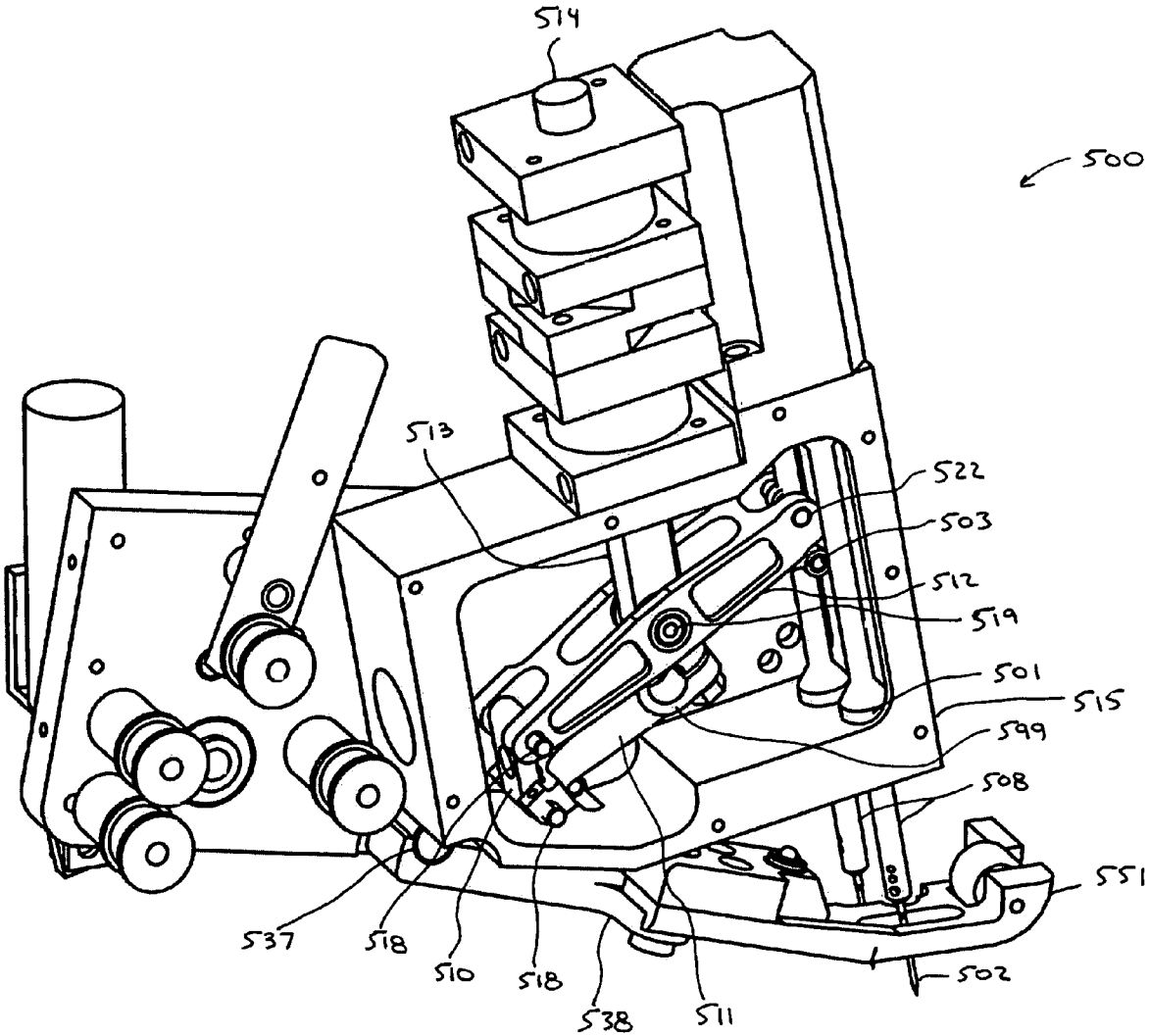
FIG. 9 is a diagram illustrating an upper rear view of the needle bar driver assembly 500 of FIG. 5, according to an illustrative embodiment of the present invention.

FIG. 9 is a diagram illustrating an upper rear view of the needle bar driver assembly 500 of FIG. 5, according to an illustrative embodiment of the present invention.

It is to be appreciated that while the preceding embodiments corresponding to FIGS. 5–9 are directed to a linking mechanism or linkage that transfers the oscillating motion of the main shaft to the needle bar and that uses a floating pin or floating pivot, given the teachings of the present invention provided herein, one of ordinary skill in the related art will contemplate these and various other implementations of a linking mechanism that has a configurable geometry dependent upon a position or interaction of a corresponding pivot or other structure, while maintaining the spirit of the present invention.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A needle bar driver assembly for an overlock sewing machine having a needle for penetrating a material to be sewed and a needle bar for securing the needle thereto, the needle bar driver assembly comprising:

a main shaft for providing an oscillating motion;

a floating pivot;

an actuating piston coupled to the floating pivot; and a linking mechanism, coupled to the main shaft and to the floating pivot, for transferring the oscillating motion of the main shaft to the needle bar while pivoting on the floating pivot.

2. The needle bar driver assembly of claim 1, wherein the linking mechanism comprises a plurality of links.

3. The needle bar driver assembly of claim 1, wherein the floating pivot changes position in relation to a reciprocating motion of the actuating piston.

4. The needle bar driver assembly of claim 1, wherein the actuating piston is for providing a reciprocating motion so as to change a position of the floating pivot when said linking mechanism is pivoting thereon.

5. The needle bar driver assembly of claim 4, wherein the actuating piston is capable of lifting the floating pivot so as to alter an oscillation geometry of the linking mechanism and extend an upper travel limit of the needle bar.

6. The needle bar driver assembly of claim 1, wherein the actuating piston is capable of raising a position of the floating pivot so as to extend an upper travel limit of the needle bar.

7. The needle bar driver assembly of claim 6, further comprising an actuating piston for providing reciprocating motion, the actuating piston being coupled to the floating pivot.

8. The needle bar driver assembly of claim 7, wherein the overlock sewing machine further includes a needle bar assembly housing, and the actuating piston is further coupled to the second end connected to the needle bar assembly housing.

9. The needle bar driver assembly of claim 1, wherein the linking mechanism comprises:

a drive arm connected to the main shaft;

a connecting link connected to the drive arm; and a rocker arm for pivoting on the floating pivot.

10. The needle bar driver assembly of claim 1, further comprising a needle bar clamp coupled to the linking mechanism and to the needle bar.

11. The needle bar driver assembly of claim 10, wherein the actuating piston is capable of raising a position of the floating pivot so as to extend an upper travel limit of the needle bar.

12. The needle bar driver assembly of claim 10, wherein the linking mechanism comprises:

a drive arm connected to the main shaft;

a connecting link connected to the drive arm; and a rocker arm for pivoting on the floating pivot.

13. The needle bar driver assembly of claim 10, wherein the overlock sewing machine further includes a needle bar assembly housing, and the actuating piston is further coupled to the needle bar assembly housing.

14. The needle bar driver assembly of claim 10, further comprising a needle bar clamp coupled to the linking mechanism and to the needle bar.

15. A needle bar driver assembly for an overlock sewing machine having a needle for penetrating a material to be sewed and a needle bar for securing the needle thereto, the needle bar driver assembly comprising:

a main shaft for providing an oscillating motion;

an actuating piston for providing reciprocating motion;

a floating pivot connected to the actuating piston; and a linking mechanism, coupled to the main shaft and to the floating pivot, for transferring the oscillating motion of the main shaft to the needle bar while pivoting on the floating pivot.

16. The needle bar driver assembly of claim 10, wherein the linking mechanism comprises a plurality of links.

17. The needle bar driver assembly of claim 10, wherein the floating pivot changes position in relation to the reciprocating motion of the actuating piston.

18. The needle bar driver assembly of claim 10, wherein the reciprocating motion of the actuating piston changes a position of the floating pivot when said linking mechanism is pivoting thereon.

19. The needle bar driver assembly of claim 18, wherein the actuating piston is capable of lifting the floating pivot so as to alter an oscillation geometry of the linking mechanism and extend an upper travel limit of the needle bar.

20. A needle bar driver assembly for an overlock sewing machine having a needle for penetrating a material to be sewed and a needle bar for securing the needle thereto, the needle bar driver assembly comprising:

a main shaft for providing an oscillating motion;

an actuating piston for providing reciprocating motion;

a floating pivot connected to the actuating piston; and a linkage, coupled to the main shaft and to the floating pivot, and having a configurable geometry dependent upon a current position of the floating pivot, for transferring the oscillating motion of the main shaft to the needle bar while pivoting on the floating pivot.

21. The needle bar driver assembly of claim 20, wherein the configurable geometry includes at least one position corresponding to a raised position of the floating pivot, for extending an upper travel limit of the needle bar.

* * * * *